US008299875B2

(12) United States Patent
Wong

(10) Patent No.: US 8,299,875 B2
(45) Date of Patent: Oct. 30, 2012

(54) CAVITY FILTER WITH TUNING STRUCTURE

(75) Inventor: Kwo-Jyr Wong, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 346 days.

(21) Appl. No.: 12/699,990

(22) Filed: Feb. 4, 2010

(65) Prior Publication Data

US 2011/0115575 A1 May 19, 2011

(30) Foreign Application Priority Data

Nov. 13, 2009 (CN) ..... 2009 2 0314693 U

(51) Int. Cl.
*H01P 1/20* (2006.01)
*H01P 7/06* (2006.01)

(52) U.S. Cl. ..... 333/203; 333/226; 333/232

(58) Field of Classification Search ..... 333/202, 333/207, 209, 223, 224, 231, 232, 235, 203
See application file for complete search history.

(56) References Cited

U.S. PATENT DOCUMENTS 3,311,839 A * 3/1967 Rutulis ..... 333/232
4,035,749 A * 7/1977 Slocum et al. ..... 333/232
4,380,747 A * 4/1983 Curtinot et al. ..... 333/202
6,198,366 B1 * 3/2001 Dahl et al. ..... 333/235

FOREIGN PATENT DOCUMENTS

JP 2002257121 A * 9/2002

* cited by examiner

*Primary Examiner* — Seungsook Ham
(74) *Attorney, Agent, or Firm* — Altis Law Group, Inc.

(57) ABSTRACT

A cavity filter defines a cavity with an opening on a top portion thereof and includes a lid to cover the opening of the cavity. A plurality of resonators are secured on a bottom portion opposite to the top portion of the cavity. The lid includes a plurality of bases extending from the lid toward the plurality of the resonators, respectively. A plurality of threaded holes penetrating the lid and one of the bases faces to the plurality of resonators, respectively. Each threaded hole includes a stopper portion extending from an inner surface of the threaded hole inward to form a step defining a hole in communication with the threaded hole. Each threaded hole corresponds to a tuning post to adjust a resonating frequency of the cavity filter.

4 Claims, 3 Drawing Sheets

CAVITY FILTER WITH TUNING STRUCTURE

BACKGROUND

1. Technical Field

The disclosure relates to cavity filters, and more particularly relates to a tuning structure of a cavity filter.

2. Description of Related Art

Cavity filters are popularly applied in mobile communications. FIG. 3 is a cross-sectional view of a commonly used cavity filter 10. The cavity filter 10 comprises a bottom portion 16 and one or more sidewalls 11 extending from edges of the bottom portion 16, which collectively define a cavity 100 with an opening on a top portion opposite to the bottom portion 16. A plurality of resonators 13 are secured on the bottom portion 16, each defining a resonating body 131 in communication with the cavity 100. A lid 12 covers the opening of the cavity 100 and comprises a plurality of bases 14 each extending from the lid 12 toward one resonator 13. A plurality of threaded holes 141 penetrate the lid 12 and one of the bases 14 facing the resonating bodies 131 of the resonators 13, respectively. Each threaded hole 141 corresponds to and receives a tuning post 15 providing adjustment of a resonating frequency of the cavity filter 10.

However, during adjustment of the resonating frequency of the cavity filter 10, metal shavings may be produced by the tuning posts 15, because the tuning posts 15 and the lid 12 are both metal. Such shavings can migrate to electronically sensitive areas of the cavity 100, with resulting intermodulation distortion (IMD) of the cavity filter 10.

Therefore, a need exists in the industry to overcome the described limitations.

DETAILED DESCRIPTION

Figure 1:
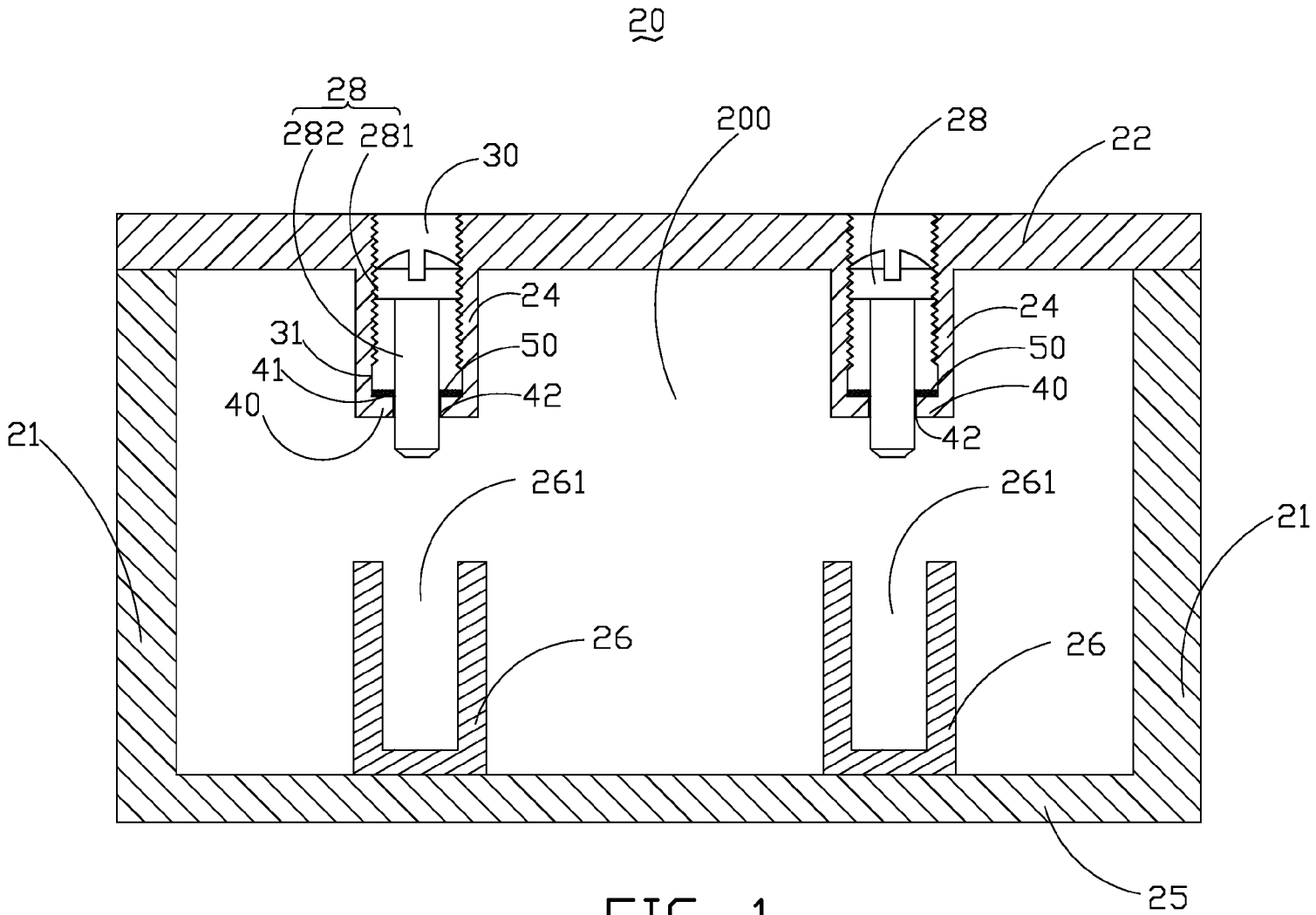
FIG. 1 is a cross-sectional view of a cavity filter in accordance with a first exemplary embodiment of the disclosure.

FIG. 1 is a cross-sectional view of a filter cavity 20 in accordance with an exemplary embodiment of the disclosure. The cavity filter 20 comprises a bottom portion 25 and one or more sidewalls 21 extending from edges of the bottom portion 25, which collectively define a cavity 200 with an open top. A plurality of resonators 26 are secured on the bottom portion 25, and each of the resonators 26 defines a resonating body 261 in communication with the cavity 200. A lid 22 covers the opening of the cavity 200 and comprises a plurality of bases 24 each extending from 22 and toward one of the resonators 26. A plurality of threaded holes 30, each penetrating the lid 22 and one of the bases 24 faces the resonating bodies 261 of the resonators 26, respectively. Each threaded hole 30 corresponds to a tuning post 28 providing adjustment of a resonating frequency of the cavity filter 20. In the embodiment, each tuning post 28 comprises a threaded portion 281 and a tuning rod 282 extending therefrom.

It should be understood that although only two resonators 26 are shown for simplification and convenience of description, with a corresponding two threaded holes 30 and two tuning posts 28 shown, more than two resonators, posts, and holes may be used without departing from the spirit of the disclosure.

In the embodiment, each threaded hole 30 comprises a stopper portion 40 extending from an inner surface 31 thereof inward so as to form a step 41 defining a through hole 42 in communication with the threaded hole 30. In the embodiment, the through hole 42 receives the tuning rod 282 of the tuning post 28. During adjustment of the resonating frequency of the cavity filter 20, the threaded portion 281 is received in the threaded hole 30 and the tuning rod 282 traverses through the through hole 42. Accordingly, the step 41 of the stopper portion 40 is able to retain metal shavings produced when the resonating frequency of the cavity filter 20 is adjusted.

In the embodiment, an outer surface of the tuning rod 282 of each tuning post 28 fits substantially snug against an inner surface of the through hole 42, preventing metal shavings from entering the cavity 200.

Alternatively, the cavity filter 20 further comprises a plurality of sticky elements 50 each located on the step 41 of the stopper portion 40 of each threaded hole 30. During adjustment of the resonating frequency of the cavity filter 20, the metal shavings cannot enter the cavity 200 because they are stuck to the sticky elements 50. Because the stopper portions 40 are weak electric field areas of the cavity filter 20, the metal shavings collected there do not influence performance of the cavity filter 20, with resulting improvement of intermodulation distortion (IMD) of the cavity filter 20, and increased stability of the cavity filter 20. In addition, the stoppers 40 may also prevent the tuning posts 28 from falling into the cavity 200, which also lowers ratio of operation defect.

Figure 2:
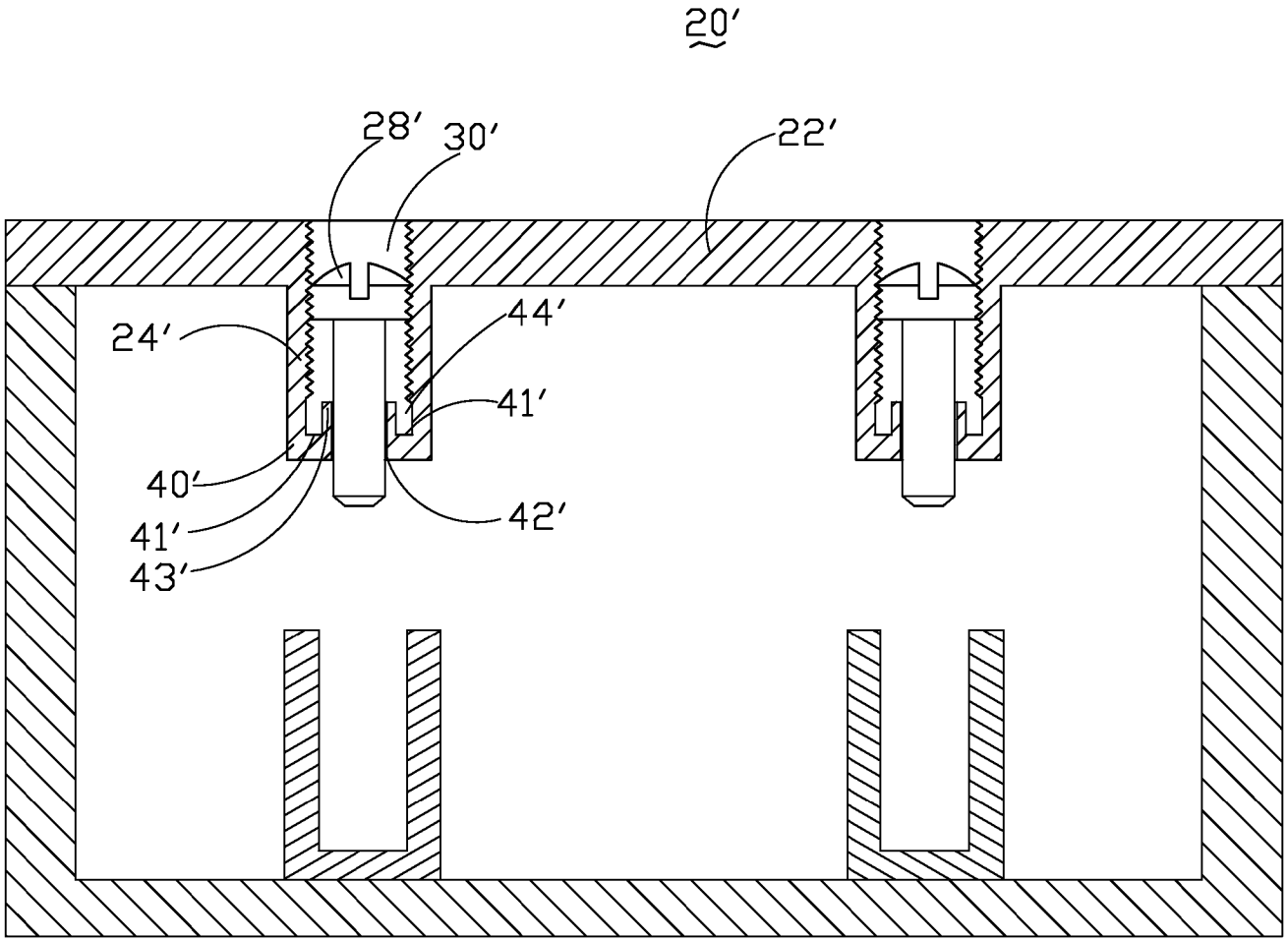
FIG. 2 is a cross-sectional view of a cavity filter in accordance with a second exemplary embodiment of the disclosure.
Figure 3:
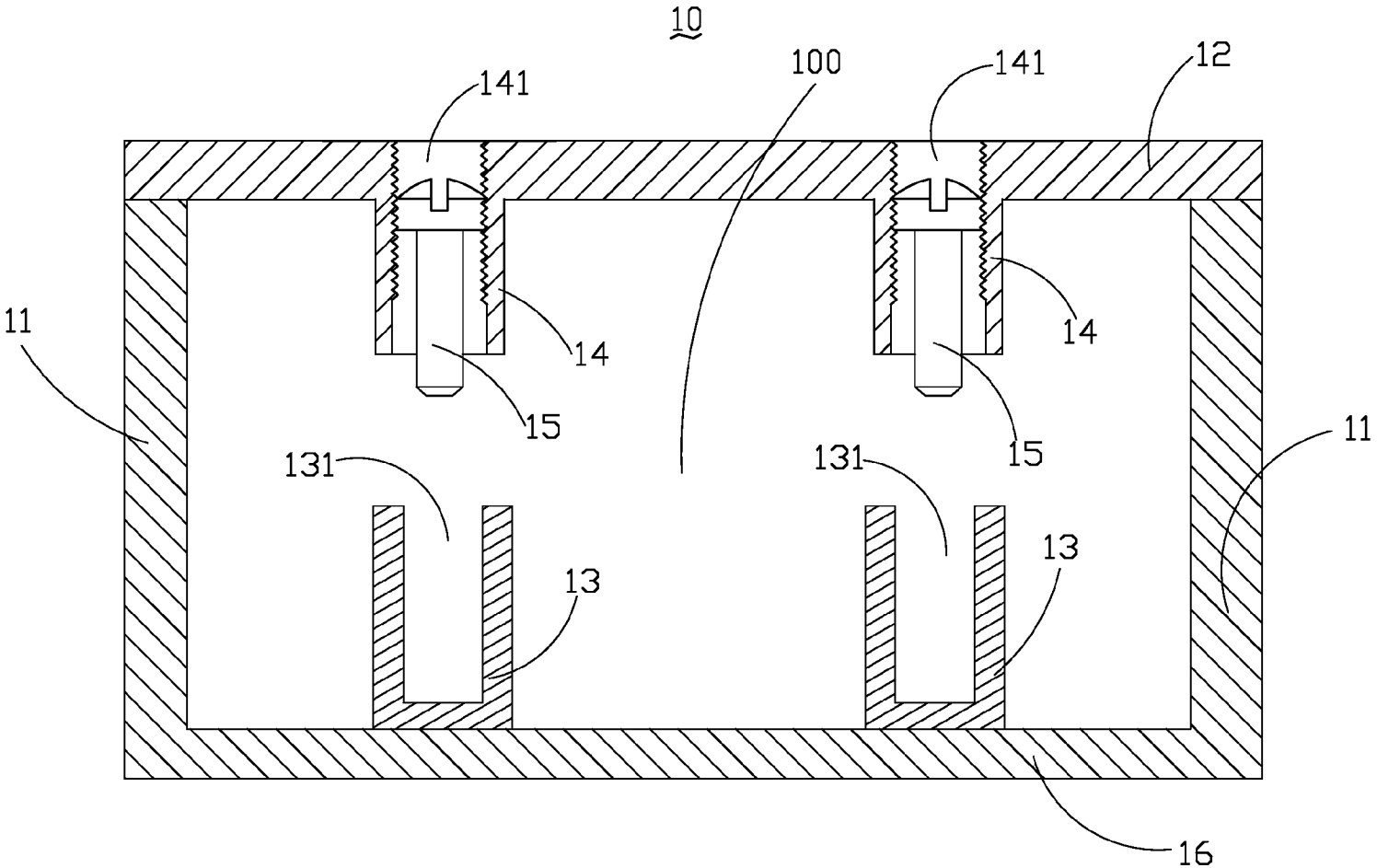
FIG. 3 (RELATED ART)
FIG. 3 is a cross-sectional view of a commonly used cavity filter.

FIG. 2 is a cross-sectional view of a cavity filter 20', differing from cavity filter 20 only in that a stopper portion 40' of each threaded hole 30' further comprises a protruding wall 43' extending from edges of a through hole 42' of the stopper portion 40' toward a lid 22' to form a groove 44' to retain metal shavings when a resonating frequency of the cavity filter 20' is adjusted.

While the exemplary embodiments have been described, it should be understood that it has been presented by way of example only and not by way of limitation. The breadth and scope of the disclosure should not be limited by the described exemplary embodiments, but only in accordance with the following claims and their equivalent.

What is claimed is:

1. A cavity filter, comprising:

a bottom portion;

one or more sidewalls extending from edges of the bottom portion so as to define a cavity therebetween and an open top;

a plurality of resonators each secured on the bottom portion of the cavity and defining a resonating body in communication with the cavity;

a lid to cover the opening of the cavity and comprising a plurality of bases each extending from the lid toward one of the plurality of the resonators;

a plurality of threaded holes each penetrating the lid and one of the plurality of bases and comprising a stopper portion extending from an inner surface of the threaded hole inward to form a step defining a through hole in communication with the threaded hole;

a plurality of sticky elements each located on the step of one of the stopper portions; and a plurality of tuning posts each comprising a threaded portion and a tuning rod extending from the threaded portion;

wherein when a resonating frequency of the cavity filter is adjusted, the threaded portion of each tuning post is received in one of the plurality of threaded holes, and the tuning rod of each tuning post traverses through the through hole of the step of the threaded hole, metal shavings produced when the resonating frequency of the cavity filter is adjusted are retained in the steps of the stopper portions.

2. The cavity filter as claimed in claim 1, wherein an outer surface of the tuning rod of each tuning post fits substantially snug against an inner surface of the through hole.

3. A cavity filter, comprising:

a bottom portion;

one or more sidewalls extending from edges of the bottom portion so as to define a cavity therebetween and an open top;

a plurality of resonators each secured on the bottom portion of the cavity and defining a resonating body in communication with the cavity;

a lid to cover the opening of the cavity and comprising a plurality of bases each extending from the lid toward one of the plurality of the resonators;

a plurality of threaded holes each penetrating the lid and one of the plurality of bases and comprising a stopper portion extending from an inner surface of the threaded hole inward to form a step defining a through hole in communication with the threaded hole;

a plurality of sticky elements each located on the step of one of the stopper portions; and a plurality of tuning posts each comprising a threaded portion and a tuning rod extending from the threaded portion;

wherein when a resonating frequency of the cavity filter is adjusted, the threaded portion of each tuning post is received in one of the plurality of threaded holes, and the tuning rod of each tuning post traverses through the through hole of the step of the threaded hole, and wherein an outer surface of the tuning rod of each tuning post fits substantially snug against an inner surface of the through hole.

4. A cavity filter, comprising:

a bottom portion;

one or more sidewalls extending from edges of the bottom portion so as to define a cavity therebetween and an open top;

a plurality of resonators each secured on the bottom portion of the cavity and defining a resonating body in communication with the cavity;

a lid to cover the opening of the cavity and comprising a plurality of bases each extending from the lid toward one of the plurality of the resonators;

a plurality of threaded holes each penetrating the lid and one of the plurality of bases and comprising a stopper portion extending from an inner surface of the threaded hole inward to form a step defining a through hole in communication with the threaded hole, wherein each stopper portion comprises a protruding wall extending from an edge of the through hole and toward the lid to form a groove; and a plurality of tuning posts each comprising a threaded portion and a tuning rod extending from the threaded portion;

wherein when a resonating frequency of the cavity filter is adjusted, the threaded portion of each tuning post is received in one of the plurality of threaded holes, and the tuning rod of each tuning post traverses through the through hole of the step of the threaded hole.

* * * * *